US005707211A

United States Patent [19]

Kochan, Sr.

[11] Patent Number: 5,707,211

[45] Date of Patent: Jan. 13, 1998

[54] VARIABLE SPEED PUMP SYSTEM WITH A HYDROPNEUMATIC BUFFER/PRESSURE TANK

[75] Inventor: John R. Kochan, Sr., Naperville, Ill.

[73] Assignee: Metropolitan Industries, Inc., Romeoville, Ill.

[21] Appl. No.: 428,501

[22] Filed: Apr. 25, 1995

[51] Int. Cl.[6] ..... F04B 49/00

[52] U.S. Cl. ..... 417/38; 417/12; 417/44.2; 417/20

[58] Field of Search ..... 417/2.5, 20, 12, 417/38, 44.2, 53, 63, 25; 60/413, 418

[56] References Cited

U.S. PATENT DOCUMENTS

| | | | |
|---|---|---|---|
| 3,639,081 | 2/1972 | Gray et al. | 417/7 |
| 3,775,025 | 11/1973 | Maher, Jr. et al. | 417/7 |
| 4,259,038 | 3/1981 | Jorgensen et al. | 417/53 |
| 4,281,968 | 8/1981 | Akers | 417/2 |
| 4,290,735 | 9/1981 | Sulko | 417/2 |
| 5,253,982 | 10/1993 | Niemiec et al. | 417/38 |
| 5,381,667 | 1/1995 | Worley et al. | 62/50.2 |

FOREIGN PATENT DOCUMENTS

| | | | |
|---|---|---|---|
| 55-125381 | 9/1980 | Japan | 417/25 |

*Primary Examiner*—Timothy Thorpe
*Assistant Examiner*—Xuan M. Thai
*Attorney, Agent, or Firm*—Dressler, Rockey, Milnamow & Katz, Ltd.

[57] ABSTRACT

A fluid pressure control system which is usable to control pressure in a fluid distribution system includes a variable speed drive coupled to a pump. A hydropneumatic tank is coupled to the distribution system. In normal operation, the variable speed drive actuates the pump so as to maintain pressure in the system. Under low flow conditions, a control unit, using the variable speed drive energizes the pump so as to pump fluid into and pressurize the hydropneumatic tank. The control unit then shuts off the pump. Pressure is maintained in the system, until a predetermined, lower, set point is reached as a result of pressure in the hydropneumatic tank.

10 Claims, 2 Drawing Sheets

VARIABLE SPEED PUMP SYSTEM WITH A HYDROPNEUMATIC BUFFER/PRESSURE TANK

FIELD OF THE INVENTION

The invention pertains to pump control systems. More particularly, the invention pertains to pump control systems which incorporate variable speed drive units for the purpose of maintaining substantially constant fluid flow pressure in a distribution system.

BACKGROUND OF THE INVENTION

A variety of control systems for actuating pumps to maintain substantially constant fluid flow pressure in fluid distribution systems are known. One type of known system uses a constant speed pump with a by-pass flow conduit to maintain substantially constant pressure in an associated fluid flow system.

By-pass type systems suffer from the disadvantage that they use electricity continuously. Additionally, a portion of the electricity, out of necessity, is nonproductive in that it merely pumps fluid through the by-pass conduit generating heat.

In other known systems, variable speed drives are used to actuate pumps on a variable speed basis in an attempt to minimize electrical costs, heat production and extend pump life. Some of the known variable speed systems incorporate a tank which is filled, at least in part, to provide a reservoir to sustain system pressure and provide fluid on demand, as, in such variable speed drive systems, the pumps are shut off when there is low or no demand.

One of the disadvantages of systems which incorporate variable speed drives is, pumps must run continuously to maintain system pressure. There continues to be a need for systems which incorporate variable speed pump drives so as to minimize or eliminate unnecessarily cycling under low flow conditions.

SUMMARY OF THE INVENTION

A fluid pressure control system in accordance with the present invention can be used for maintaining a preset fluid pressure in a distribution system which incorporates a fluid storage tank. The tank has a reservoir which is in fluid flow communication with the distribution system.

The control system incorporates a pump, which can be operated at a variable rate, and which is coupled to the distribution system. A variable speed drive circuit is in turn coupled to the pump.

A control unit is coupled to the drive circuit. System pressure is monitored via a pressure transducer coupled between the control unit and the fluid flow system.

Under normal operating conditions, the system actuates the pump on a variable rate basis to maintain fluid flow pressure at the predetermined normal pressure set point. Under low flow conditions, which can be required to be present for a predetermined period of time, the control unit pressurizes the system to a higher than normal pressure which exceeds the normal system pressure set point.

Once the pressure has reached the high pressure set point, the electrical drive to the pump is terminated. Fluid can be drawn from the system on demand as a result of the above normal pressure level and the tank. The pump is not actuated again until the system pressure falls to a low pressure set point, which can be below or at the normal pressure set point.

When a low pressure condition is detected, the pump is actuated on a variable rate basis so as to pump fluid and restore pressure to the normal pressure set point. A timer can be provided to provide a predetermined, operator specifiable time interval during which the low flow rate condition must be present so as to switch into the above described high pressure mode. The tank can be a sealed hydropneumatic type.

These and other aspects and attributes of the present invention will be discussed with reference to the following drawings and accompanying specification.

DETAILED DESCRIPTION OF THE PREFERRED EMBODIMENT

Figure 1:
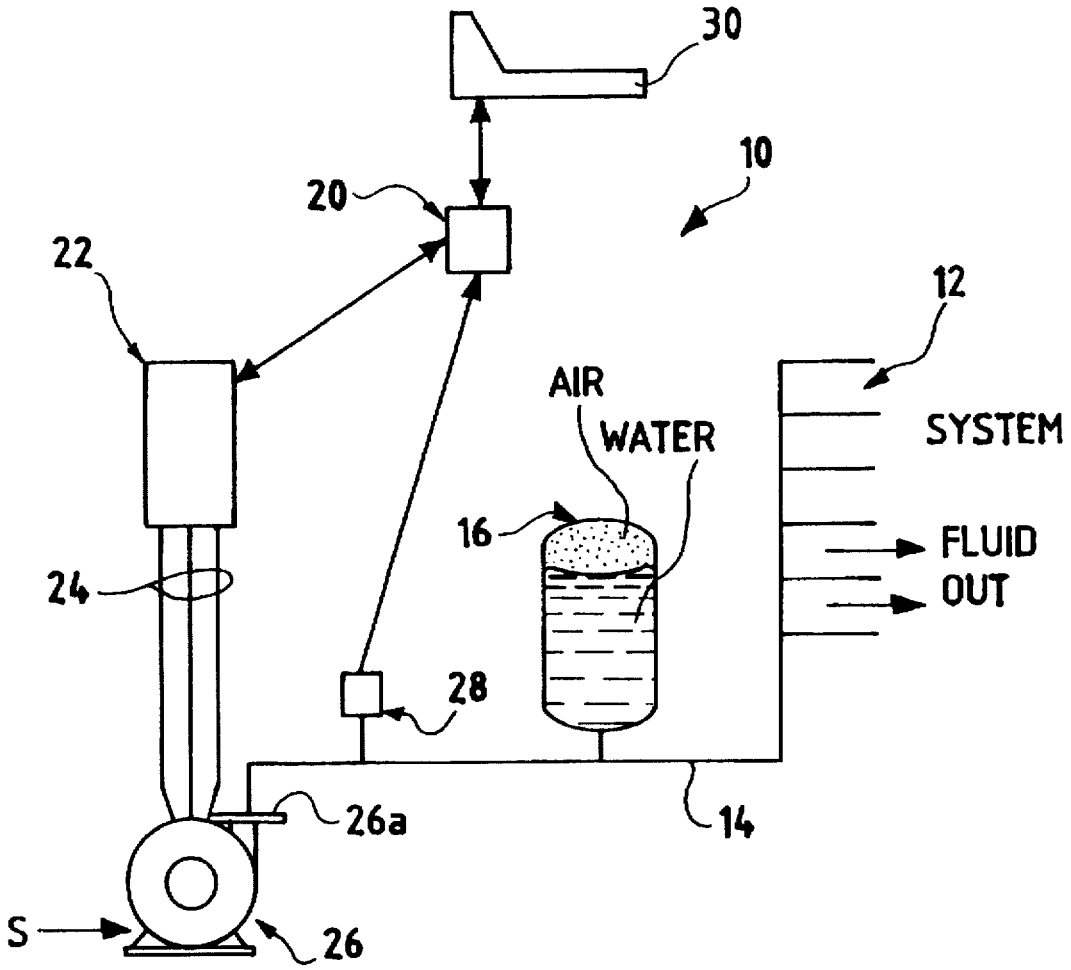
FIG. 1 is a block diagram of a system in accordance with the present invention.

While this invention can be embodied in different structures and methods, there are shown in the drawing, and will be described herein in detail, specific embodiments thereof with the understanding that the present disclosure is to be considered as an exemplification of the principles of the invention and is not intended to limit the invention to the specific embodiments illustrated.

With respect to FIG. 1, a system 10 which embodies the present invention is capable of being used with a fluid distribution system generally indicated at 12. The system 12 includes a plurality of fluid flow conduits or pipes 14. The system 10 provides a continuous flow of fluid under pressure in accordance with various set points which can be established by an operator.

The system 10 can be used to provide fluid pressure control in residential water systems where the source of water is a well. Alternately, the system 10 can be used in commercial or residential high-rise buildings, industrial sites or selected municipal applications wherein control fluid pressure from a source is required. Types of fluid include drinking water as well as waste water or run-off.

As illustrated in FIG. 1, the system 12 includes a sealed, hydropneumatic tank 16 which functions as a buffer and makes possible a particularly advantageous form of operation of the system 10. The tank 16, which is illustrated in a preferred form as a hydropneumatic tank is not limited to a hydropneumatic tank and could be, if desired, an elevated storage tank which is not sealed.

The system 10 includes a control unit 20 which could be implemented as either a hard wired or a programmable controller. Various forms of programmable controllers fall within the spirit and scope of the present invention including those which include programmable microprocessors.

The controller 20 is in turn coupled to a variable speed drive 22 of a known variety. Representative types of variable speed drives which can be used with the present invention include Graham Model 1703 AFC and ASEA Brown Bover, Model ACH-500 Series. The variable speed drive 22 is coupled via single phase or three phase electrical lines 24 to a pump 26.

An input port of the pump 26 is connected and is in fluid flow communication with a reservoir or source S of the fluid whose pressure is to be controlled. An output port 26a of the pump 26 is coupled to the conduit or pipe 14 for the system 12.

A pressure transducer 28 is also coupled to the conduit 14 and provides an output signal, which could be an electrical signal, which is proportional to fluid pressure in the conduit 14. The transducer 28 is in turn coupled to the controller 20.

Operator communication can be provided via a keyboard and a video display of a terminal 30 coupled to the control unit 20. System status can be displayed on the terminal 30. Alternately, the keyboard of the terminal 30 can be used to intercept points and other control related information. It will be understood that the type of operator input device is not a limitation of the present invention.

In normal operation, the system 10 operates under the control of the programmable unit 20. The variable speed drive is energized by the control unit 20 to actuate the pump 26 on a variable speed basis so as to maintain system pressure in accordance with a preset, normal pressure set point. This set point can be established by an operator via the keyboard of the terminal 30. The control unit 20 monitors fluid pressure in the system 12 via the transducer 28.

It is to be observed that the system 10 does not provide a by-pass around the pump 26 as is known in many types of pump systems. The system 10 functions satisfactorily without a by-pass around the pump 26 because of the use of a variable speed drive, such as the drive 22 which makes it possible to completely shut off the pump 26 from time to time, under control of the unit 20. However, it is possible to actuate the pump 26 at maximum speed when a significant drop in pressure is detected via the transducer 28.

When the control unit 20 senses, via feedback from the variable speed drive 22 for example, that the pump 26 is operating under low flow conditions, indicated by minimal or low current being supplied by the drive 22 to the pump 26 to maintain pressure or by means of a flow meter and where this condition is detected for a predetermined, adjustable, time interval, then the system 10 will switch automatically to a second mode of operation.

It will be understood that the predetermined time interval can be established via the keyboard of the terminal 30. The control unit 20, as is known, can incorporate a real time clock and an associated timer. The timer can be implemented in either hardware or software and can be used to monitor whether the preset time interval, for the low flow condition, has elapsed.

When the low flow condition, for the preset time interval has been detected, the control unit 20 will energize the drive 22, which in turn, actuates pump 26 causing that pump to increase speed and pressurize the system 12 including the tank 16 to a preset high pressure set point. When the system pressure equals or exceeds the high pressure set point, as determined via the transducer 28, the actuation of the pump 26 is terminated.

The tank 16 will now provide fluid to maintain system pressure in response to demands for fluid until pressure in the system 12 drops to a predetermined low pressure set point. This low pressure set point also could be established via the keyboard of the terminal 30. This low pressure set point would, in normal operating circumstances be lower than the normal pressure set point.

In a circumstance where pressure drops to the low pressure set point, the controller 20 will then energize drive 22 to actuate pump 26 on a variable speed basis to increase pressure in the system 12 to the normal pressure set point value.

If desired, an additional timer can be incorporated, either as a hardware or software structure, in the controller 20 to prevent the system 10 from cycling during known low flow timer intervals, for example, in commercial buildings, these time intervals might run from 11:00 p.m. to 5:00 a.m.

Figure 2:
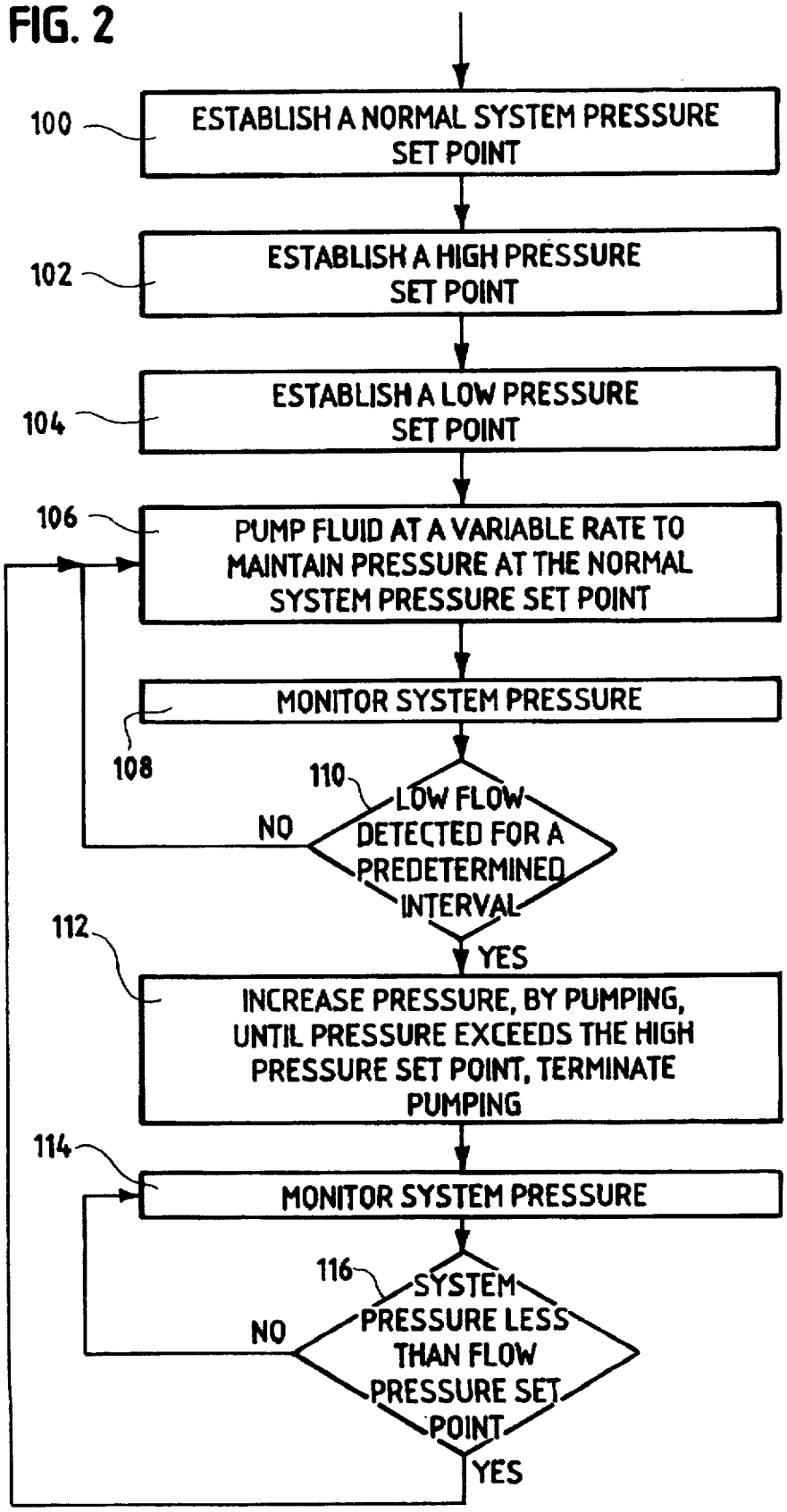
FIG. 2 is a flow diagram of a method of fluid pressure control in accordance with the present invention.

FIG. 2 is a flow diagram illustrating a method in accordance with the present invention. In a step 100, a normal system pressure set point is established. In a step 102, a high pressure set point is established. In a step 104, a low pressure set point is established.

In step 106, fluid is pumped via pump 26 at a variable rate so as to maintain pressure in the system at the predetermined, normal system pressure set point. In a step 108, system pressure is monitored by the control unit 20 via transducer 28.

In a step 110, a determination is made as to whether or not a low flow condition has been detected for a predetermined time interval, via the controller 20.

If not, the system returns to the step 106 and continues to provide fluid under pressure at a variable rate. If the low flow condition is detected, in a step 112, the pump 26 is actuated to increase pressure in the system 12 until the pressure exceeds the high pressure set point actuation of the pump 26 is then terminated. In a step 114, the control unit 20 continuously monitors system pressure.

In a step 116, the control unit 20 determines whether or not system pressure has fallen below the low pressure set point. If so, it initiates actuation of the pump 26, via the variable speed drive 22 to pump fluid at a variable rate to restore system pressure to the normal system pressure set point.

From the foregoing, it will be observed that numerous variations and modifications may be effected without departing from the spirit and scope of the invention. It is to be understood that no limitation with respect to the specific apparatus illustrated herein is intended or should be inferred. It is, of course, intended to cover by the appended claims all such modifications as fall within the scope of the claims.

What is claimed is:

1. A method of controlling pressure in a fluid distribution system having a storage reservoir comprising:

establishing a normal fluid pressure set point;

establishing a high pressure set point, greater than the normal pressure set point;

establishing a low pressure set point;

establishing a first condition;

detecting the presence of the first condition, and responsive thereto, pumping fluid, at a variable rate, into the storage reservoir until the system pressure equals the high pressure set point and thereupon terminating pumping;

monitoring pressure in the system, without pumping fluid, until the pressure falls to the low pressure set point; and responsive to the pressure equalling the low pressure set point, pumping fluid at a variable rate, until the system pressure increases to the normal pressure set point.

2. A method as in claim 1 which includes:

establishing a low flow time interval; and determining when a predetermined low flow rate is present for the low flow interval thereby detecting the presence of the first condition.

3. A method as in claim 1 which includes, in response to the detected first condition, and subsequent to terminating pumping, inhibiting further pumping for a predetermined time interval.

4. A method of controlling pressure in a fluid distribution system having a storage reservoir comprising:

establishing a normal fluid pressure set point;

establishing a high pressure set point, greater than the normal pressure set point;

establishing a low pressure set point;

establishing a low flow interval;

establishing a first condition;

determining when a predetermined low flow rate is present for the low flow interval thereby detecting the presence of the first condition, and responsive thereto, pumping fluid into the storage reservoir until the system pressure equals the high pressure set point and thereupon terminating pumping; wherein in response to the detected condition, and subsequent to terminating pumping, inhibiting further pumping for a predetermined time interval;

monitoring pressure in the system, without pumping fluid, until the pressure falls to the low pressure set point; and responsive to the pressure equalling the low pressure set point, pumping fluid until the system pressure increases to the normal pressure set point.

5. A method of controlling pressure in a fluid distribution system having a storage reservoir comprising:

establishing a normal fluid pressure set point;

establishing a high pressure set point, greater than the normal pressure set point;

establishing a low pressure set point;

establishing a low flow time interval;

determining when a predetermined low flow rate is present for the low flow time interval and responsive thereto, pumping fluid into the storage reservoir until the system pressure substantially equals the high pressure set point and thereupon terminating pumping;

monitoring pressure in the system, without pumping fluid, until the pressure falls to the low pressure set point; and responsive to the pressure substantially equalling the low pressure set point, pumping fluid until the system pressure increases to the normal pressure set point.

6. A method as in claim 5 which includes, subsequent to terminating pumping, inhibiting further pumping for a predetermined time interval.

7. A system couplable to a fluid source for maintaining a preset fluid pressure in a distribution system comprising:

a fluid storage tank with a fluid flow port;

at least one pump with an output port;

a conduit coupled to the port of the tank and to the output port of the pump to the distribution system;

a pressure transducer coupled to the conduit; and a control unit coupled to the transducer and the pump wherein the control unit receives a normal system pressure set point, a high pressure set point, a low pressure set point and wherein the control unit includes circuitry to energize the pump to maintain system pressure substantially at the normal system pressure set point, wherein the control unit establishes a low flow interval, and in response to detecting a low flow condition, energizes the pump to increase system pressure to the high pressure set point whereupon the pump is de-energize and wherein the control unit, in response to detecting a system pressure below the low pressure set point, energizes the pump until system pressure increases to the normal pressure set point.

8. A system as in claim 7 wherein the control unit includes a clock for establishing said low flow interval which must be exceeded by a low flow condition before the control unit increases system pressure to the high pressure set point.

9. A system as in claim 7 wherein the control unit includes a variable speed drive coupled to the pump.

10. A system as in claim 8 wherein the tank is a hydropneumatic tank.

* * * * *